US007445678B2

(12) United States Patent
Mishima et al.

(10) Patent No.: US 7,445,678 B2
(45) Date of Patent: Nov. 4, 2008

(54) MARAGING STEEL AND METHOD OF PRODUCING THE SAME

(75) Inventors: Setsuo Mishima, Matsue (JP); Hidemi Takao, Matsue (JP); Ken-ichiro Hara, Yonago (JP); Etsuo Fujita, Yasugi (JP)

(73) Assignee: Hitachi Metals, Ltd., Tokyo (JP)

( * ) Notice: Subject to any disclaimer, the term of this patent is extended or adjusted under 35 U.S.C. 154(b) by 104 days.

(21) Appl. No.: 10/715,568

(22) Filed: Nov. 19, 2003

(65) Prior Publication Data

US 2004/0093983 A1 May 20, 2004

(30) Foreign Application Priority Data

Nov. 19, 2002 (JP) ..... 2002-335248
Feb. 7, 2003 (JP) ..... 2003-031453

(51) Int. Cl.

| | |
|---|---|
| ***C22C 3/00*** | (2006.01) |
| ***C22C 29/16*** | (2006.01) |
| ***C21D 3/00*** | (2006.01) |
| ***C21B 7/04*** | (2006.01) |

(52) U.S. Cl. ..... 148/221; 148/228; 75/10.23; 75/10.25

(58) Field of Classification Search ..... 75/10.25, 75/10.23; 148/624, 404, 221, 228; 420/95
See application file for complete search history.

(56) References Cited

U.S. PATENT DOCUMENTS

| | | | | |
|---|---|---|---|---|
| 4,443,254 | A * | 4/1984 | Floreen | 420/96 |
| 4,871,511 | A * | 10/1989 | Smith et al. | 420/96 |
| 6,562,153 | B1 * | 5/2003 | Uehara et al. | 148/325 |
| 6,663,730 | B2 * | 12/2003 | Coutu | 148/624 |
| 6,767,414 | B2 * | 7/2004 | Uehara et al. | 148/318 |
| 6,776,855 | B1 * | 8/2004 | Ueda et al. | 148/328 |
| 6,918,969 | B2 * | 7/2005 | Zeze et al. | 148/404 |

FOREIGN PATENT DOCUMENTS

| | | | |
|---|---|---|---|
| EP | 1-111080 | A2 | 6/2001 |
| GB | 2 043 113 | A | 10/1980 |
| JP | 55-028384 | | 2/1980 |
| JP | 55-091923 | A | 7/1980 |
| JP | 56090957 | | 7/1981 |
| JP | 5825457 | A1 | 2/1983 |
| JP | 5964744 | | 4/1984 |
| JP | 04-002745 | | 1/1992 |
| JP | 05-186813 | | 7/1993 |
| JP | 11-293407 | | 10/1999 |
| JP | 2000-297353 | | 10/2000 |
| JP | 2001-214212 | A | 8/2001 |
| JP | 2002-161309 | | 6/2002 |
| JP | 2003-183765 | | 7/2003 |
| WO | WO 02/40722 | A1 | 5/2002 |

OTHER PUBLICATIONS

Metals Handbook, Desk Edition, 2nd edition, 1998, ASM International, pp. 264-265.*
Metals Handbook, Desk Edition, 2nd Edition, ASM International, 1998, pp. 21 and 38.*
Database WPI Section Ch, week 197648 Derwent Publication Ltd., London, GB; AN 1976-90042X XP002270875, SU 502974, one page abstract, May 24, 1976.

* cited by examiner

*Primary Examiner*—Roy King
*Assistant Examiner*—Tima M McGuthry-Banks
(74) *Attorney, Agent, or Firm*—Sughrue Mion, PLLC

(57) ABSTRACT

Disclosed is a method of producing maraging steel, which includes producing a consumable electrode for vacuum remelting; and subjecting the consumable electrode to the vacuum remelting. The consumable electrode contains not less 5 ppm Mg. Disclosed is also a maraging steel containing, by mass %, at least, from more than zero to less than 10 ppm Mg, less than 10 ppm oxygen, and less than 15 ppm nitrogen. The steel contains also nitride inclusions having a maximum length of not more than 15 μm and oxide inclusions having a maximum length of not more than 20 μm. Regarding the oxide inclusions, a content rate of spinel form inclusions having a length of not less than 10 μm to a total content of the spinel form inclusions having a length of not less than 10 μm and alumina inclusions having a length of not less than 10 μm exceeds 0.33 (i.e. 33%).

20 Claims, 5 Drawing Sheets

10μm

MARAGING STEEL AND METHOD OF PRODUCING THE SAME

BACKGROUND OF THE INVENTION

The present invention relates to maraging steel and a method of producing the same.

Since maraging steel has a very high tensile strength of around 2000 MPa, the maraging steel has been used for members, which are required to have high strength, such as those for rockets, centrifugal separators, aircraft, and continuously variable transmissions of automobile engines, tool, die, and so on.

The maraging steel usually contains, as strengthening elements, appropriate amount of Mo and Ti, so that the maraging steel can have high strength, which is achieved by such an aging treatment as to precipitate intermetallic compounds such as $Ni_3Mo$, $Ni_3Ti$, and $Fe_2Mo$. A typical maraging steel containing Mo and Ti has a chemical composition of, by mass percent, 18% Ni, 8% Co, 5% Mo, 0.45% Ti, 0.1% Al and the balance of Fe.

However, while the maraging steel can have very high tensile strength, fatigue strength thereof is not necessarily high. The most notabilian factors deteriorating fatigue strength of the maraging steel is non-metallic inclusions of nitride and/or carbonitride such as TiN and TiCN. When the non-metallic inclusions coarsen in the steel, fatigue fracture is initiated from the inclusions.

Thus, in general, in order to reduce the non-metallic inclusions in the steel, a vacuum arc remelting process (hereinafter referred to as VAR) has been used.

The maraging steel produced by the VAR process has advantages that it is homogeneous (i.e. small segregation) and that the amount of non-metallic inclusions is reduced.

However, comparatively large non-metallic inclusions of nitrides or carbonitrides such as TiN and TiCN also remain in the maraging steel produced by the VAR process. The residual large non-metallic inclusions still exist in the material after hot forging, heat treatment, hot rolling, and cold rolling which are performed after VAR. This has been a cause of fatigue fracture initiated from large residual non-metallic inclusions.

In order to solve the problem, various proposals have been made. For example, in JP-A-2001-214212, a method of producing Ti-containing steel is disclosed, according to which a raw material of Ti-containing steel without titanium-nitride inclusions is melted in a vacuum induction furnace, and cast to produce a Ti-containing steel material as an electrode, and the material is re-melted in a vacuum arc melting process to refine the titanium-nitride inclusions.

The present inventors have studied further enhancement of cleanliness of the maraging steel.

In the JP-A-2001-214212, the raw materials for Ti-containing steel, which do not contain nitride inclusions such as TiN and TiCN can be used to refine titanium-nitride inclusions. This management of qualities of the raw materials is one measure for reducing the nitride-base non-metallic inclusions, but there is a problem that a high-grade raw material is naturally an expensive raw material and cost is high.

Moreover, since the generation of the titanium-nitride inclusions also depends on melting conditions, the problem cannot sufficiently be solved only by the management of the raw materials.

Additionally, the maraging steel has a very high tensile strength of around 2000 MPa, but the fatigue fracture caused from the residual non-metallic inclusions which are the fracture origin in a high fatigue region exceeding $10^7$ times has raised a problem. Especially, when the maraging steel is formed into a thin strip, there is a high possibility of breakage of the thin strip by propagation of fracture of the non-metallic inclusions.

The fatigue fracture by the non-metallic inclusions is determined by the size of the non-metallic inclusion. When the maraging steel is applied to a thin strip material, the presence of the non-metallic inclusion itself raises a large problem with the use in the high fatigue region exceeding $10^7$ times.

Further, actually, in the maraging steel, oxide inclusions are also confirmed in addition to nitride inclusions. The number of existing oxide inclusions is small, but the inclusions having a comparatively large size, for example, a diameter exceeding 20 μm, are sometimes confirmed.

There is a concern about that the presence of such large oxide inclusions adversely affect mechanical characteristics of the material such as the fatigue strength like as in the case of nitride inclusions such as TiN.

The examples of the method of reducing the non-metallic inclusions caused by gas components such as nitride and oxide include vacuum remelting processes such as VAR, but there is a limitation onto the reduction of the size of the nitride or oxide inclusion only with the application of VAR. Therefore, there has been a strong demand for development of a new breakthrough technique which is remarkably effective in reducing the size of the non-metallic inclusion of the maraging steel.

BRIEF SUMMARY OF THE INVENTION

In the light of the above problems, an object of the present invention is to provide a method of producing maraging steel and a novel maraging steel obtained by the method, wherein according to the method, the size of residual non-metallic inclusions in the maraging steel can be remarkably reduced.

The present inventors researched a causal relation between generation behaviors of non-metallic inclusions caused by gas components in maraging steel in a melting process, refining process and remelting process, and elements existing in the melt, and found significant effects of Mg added in a consumable electrode to be used in vacuum remelting, which effects are to reduce the amount of non-metallic inclusions and refine (i.e. make fine) non-metallic inclusions, whereby the present invention was achieved.

Accordingly, there is provided a method of producing maraging steel, which comprises producing a consumable electrode made of the steel for vacuum remelting, and subsequently subjecting the consumable electrode to vacuum remelting, wherein the consumable electrode comprises not less than 5 ppm of Mg.

Preferably, the consumable electrode is produced by a vacuum induction melting process.

Further preferably, the vacuum remelting is conducted by a vacuum arc remelting process.

In the invention method, preferably a maraging steel material obtained by the vacuum remelting is subjected to plastic working to produce a thin strip having a thickness of not more than 0.5 mm.

The invention maraging steel comprises, by mass percent, at least, from more than zero to less than 10 ppm Mg, less than 10 ppm oxygen, and less than 15 ppm nitrogen, and further contains nitride inclusions having a maximum length of not more than 15 μm and oxide inclusions having a maximum length of not more than 20 μm. In the oxide inclusions, a content rate of spinel form inclusions having a length of not less than 10 μm to a total content of the spinel form inclusions having a length of not less than 10 μm and $Al_2O_3$ inclusions having a length of not less than 10 μm exceeds 0.33 (i.e. 33%).

Preferably, the maraging steel has a chemical composition that it consists essentially of, by mass percent, from more than zero to less than 10 ppm Mg, less than 10 ppm oxygen, and less than 15 ppm nitrogen, not more than 0.01% C, 8.0 to 22.0% Ni, 5.0 to 20.0% Co, 2.0 to 9.0% Mo, not more than 2.0% Ti, not more than 1.7% Al, and the balance of Fe and incidental impurities.

A thin strip made of the above maraging steel is also provided, which has a thickness of not more than 0.5 mm.

According to the maraging steel, oxide-base non-metallic inclusions can be reduced in size and amount (i.e. the amount is that of large oxide inclusions each having a size of more than 20 μm). It is also possible to reduce the size of nitride-base non-metallic inclusions such as TiN and TiCN. Thus, the maraging steel has an improved fatigue strength.

The invention thin strips most suitable to a component of a continuously variable transmission of an automobile engine.

DETAILED DESCRIPTION OF THE INVENTION

Figure 1:
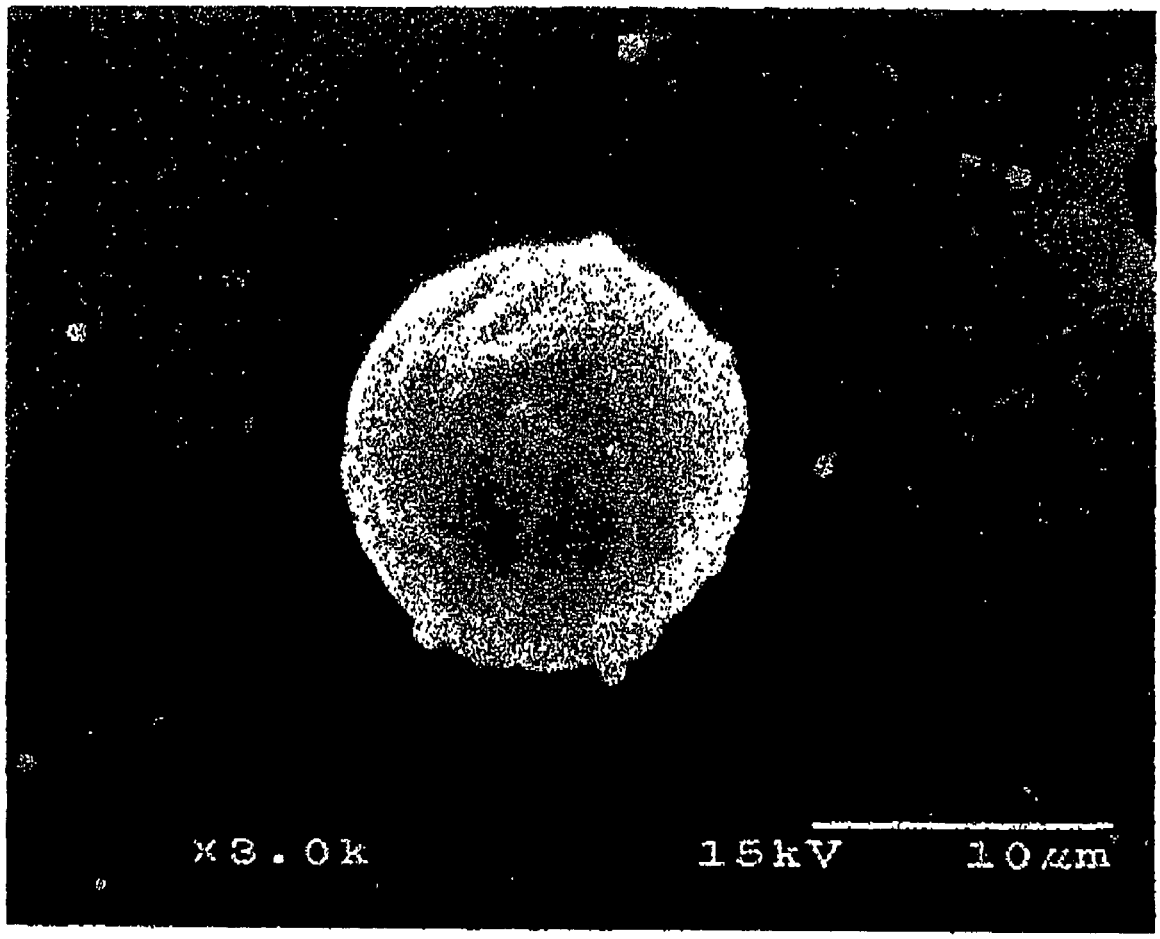
FIG. 1 is an electron microscopic photograph showing one example of a spinel form inclusion.

A key aspect of the present invention resides in that a consumable electrode for use in vacuum remelting, such as VAR and vacuum ESR, is made to contain a specific amount of Mg. It is believed that the (reducing and) refining effects of the non-metallic inclusions by addition of Mg into the consumable electrode is based on the following.

When an appropriate amount of Mg is added, oxygen existing during melting in a process of producing the consumable electrode is combined with Mg higher in affinity than Al constituting an origin of alumina which is a typical non-metallic inclusion to generate many magnesia inclusions mainly composed of MgO.

Moreover, since agglomeration of the magnesia inclusions is weaker than that of alumina, excessively large oxide inclusions are reduced in the electrode. It should be noted that for an actual mode of the oxide inclusions, there are Al—Mg—O system ($MgO—Al_2O_3$ system) spinel form inclusions in same cases.

Furthermore, when magnesia weak in agglomeration is formed in a large quantity, magnesia is used as a nucleus to produce nitride or carbonitride, and accordingly nitride or carbonitride in the consumable electrode is refined.

When the consumable electrode is subjected to vacuum remelting, evaporation of Mg that is a volatile element in a high-temperature region occurs, and the magnesia or spinel form non-metallic inclusions are decomposed, and diffused in a gas phase and liquid phase of oxygen. That is, magnesia is decomposed to promote the reduction of oxide. Oxygen is partially diffused in the liquid phase, but the amount of the oxide inclusions newly generated by oxygen is not large, and, as a result, the oxide inclusions are refined.

On the other hand, the nitride inclusions such as TiN and TiCN also use magnesia as the nucleus and finely exist in the consumable electrode. Therefore, thermal decomposition of the nitride inclusions is also promoted during the remelting, and, as a result, the refining of the nitride inclusions is achieved.

By the above-described presumed function, it is possible to provide maraging steel in which the non-metallic inclusions are reduced and refined more remarkably than in the maraging steel obtained by the related art.

In the maraging steel, the elements such as Ti and Al are required which contribute to strengthening by forming and precipitating fine intermetallic compounds by an aging treatment, but these elements have an unavoidable problem that the non-metallic inclusions are formed.

The development of a producing technique using Mg, found by the present invention, is a remarkably effective breakthrough technique which can establish both the reducing and refining effects with respect to both the nitride and oxide inclusions.

It should be noted that in consideration of adverse influences of the nitride inclusions such as TiN and TiCN, the maraging steel to which Ti is not added intentionally or Ti is limited in a range of less than 0.2% has also been proposed. However, since the adverse influences of the nitride inclusions such as TiN and TiCN can be eliminated by the effect of the producing method of the present invention, Ti is positively added, and the strengthening effect by Ti can be fulfilled to the maximum.

Therefore, the producing method of the present invention is especially effective for the maraging steel which contains not less than 0.3% of Ti.

It should be noted that in the present invention the vacuum remelting means that the remelting is performed while performing evacuation.

In the producing method of the present invention, it was defined the consumable electrode contains not less than 5 ppm of Mg, This is because the reducing and refining effects of the non-metallic inclusions by the addition of Mg are not remarkably fulfilled with less than 5 ppm of Mg.

In consideration of toughness of a steel ingot or product after remelted, an upper limit of an Mg concentration in the consumable electrode is preferably not more than 300 ppm. With a content of 5 to 250 ppm, the above-described effect is obtained, and therefore the upper limit may be 250 ppm.

Additionally, the addition of Mg strong in volatile is low in yield and is not economical. Moreover, Mg rapidly evaporates in the vacuum remelting, impairs operation, and deteriorates the surface of the steel ingot in some case. Therefore, the upper limit of the Mg concentration may preferably be 200 ppm. A more preferable range is a range of 10 to 150 ppm.

In the present invention, the application of a vacuum induction melting process (hereinafter referred to as VIM) is preferable in producing the consumable electrode. This is because a melting raw material in crucible is melted in vacuum, and therefore an increase of oxide or carbonitride in steel by reaction of oxygen or nitrogen in the atmosphere with molten steel is avoided. Moreover, oxygen and active Mg are advantageously steadily added into molten steel, and the process has a function capable of removing unavoidably mixed oxygen or nitrogen from the raw materials.

Especially, since the maraging steel contains active Ti, contact of a molten metal with the atmosphere has to be avoided as much as possible. It is optimum to apply VIM in which the consumable electrode can be produced in the environment blocked from the atmosphere.

It should be noted that a melting equipment having a similar function, that is, a function of being capable of preventing molten steel from being contaminated by the atmosphere and adding Mg may be used instead of VIM.

The vacuum remelting process includes an electron beam remelting process in addition to a vacuum arc remelting process. However, the electron beam remelting process has a problem that a running cost is high, temperature of the surface of molten steel irradiated with a beam under high vacuum is high, selective evaporation of the element occurs, and it is difficult to control components. Moreover, in a vacuum electro slug remelting process, the effect of Mg addition is obtained in the same manner as in the vacuum arc remelting process, but evaporation phenomenon of Mg is inhibited by slug, and the Mg addition effect is reduced. Therefore, the vacuum arc remelting process is preferable for the vacuum remelting in the present invention.

When the maraging steel produced by the above-described method is applied to a component for a continuously variable transmission of an automobile engine, steel is formed into a thin strip having a thickness of not more than 0.5 mm by plastic working such as hot rolling and cold rolling.

By the plastic working performed after the vacuum remelting, the oxide inclusions is crushed or extended or torn, and can be refined. For example, magnesia generated by Mg addition or a cluster of spinel form inclusions that take place during the vacuum remelting is also segmentized and refined by the hot or cold plastic working.

By a combination of the plastic working, the thin strip is especially preferable as a maraging steel thin strip for the component for the continuously variable transmission, which has a high fatigue strength.

It should be noted that in order to form the maraging steel thin strip to be more suitable for the component for the continuously variable transmission, a homogenizing heat treatment may be applied in which the material is held either or both in a steel ingot state after the vacuum remelting or in a state after hot forging at 1000 to 1300° C. for at least five hours or more to reduce segregation of components.

When the homogenizing heat treatment is conducted, the segregation can further be reduced. When the homogenizing heat treatment is performed at high temperature for a long time, the segregation is further reduced. However, when the retention temperature exceeds 1300° C., surface oxidation is excessively promoted. Conversely, when the temperature is lower than 1000° C., the effect is small. Therefore, the material may be retained at 1000° C. to 1300° C.

Moreover, the retention time of the homogenizing heat treatment is shorter than five hours, the effect of homogenization is small. Therefore, the retention time is preferably at least five hours or more. The segregation of Ti and Mo easily causing the segregation when subjected to the homogenizing heat treatment is linearly analyzed in EPMA. At this time, maximum and minimum values are measured, a rate (maximum value/minimum value) is calculated, and a range of not more than 1.3 can be set.

As described above, when the appropriate amount of Mg is added, it is possible to reduce the sizes of the nitride-base non-metallic inclusions. To more securely obtain this effect, the following method is effective:

(1) a coagulation speed at the time of the producing of the electrode steel ingot is increased;

(2) a nitrogen concentration of the electrode steel ingot is reduced; and (3) the sizes of the non-metallic inclusions of nitride or carbonitride existing in the electrode are adjusted to be not more than 10 μm at maximum.

It is effective to apply the above-described producing methods alone or as a combination of several methods.

As described above, in the maraging steel to which the producing method is applied, by the positive addition of Mg, the characteristic mode of the oxide inclusions, which has not be seen in conventional maraging steel, is obtained by the positive addition of Mg. The nitride inclusions such as nitride and carbonitride are also refined.

Concretely, the non-metallic inclusions of MgO alone exist, although the inclusions are very little and cannot easily be found even in electron microscope observation. Alternatively, the spinel form inclusions having a size of not less than 10 μm exceeds 33% with respect to a total amount of the spinel form inclusions having a size of 10 μm or more and alumina inclusions having a size of not less than 10 μm.

This is very characteristic in that about 80% of alumina inclusions can be confirmed, when Mg is not positively added at the time of the producing of the consumable electrode, but the spinel form inclusions having a size of 10 μm or more exceeds 33% with respect to the total amount of the spinel form inclusions having a size of 10 μm or more and the alumina inclusions having a size of 10 μm or more with the application of the producing method of the present invention. The spinel form inclusions having a size of not less than 10 μm is more preferably in a range of not less than 50%, further preferably in a range of not less than 70%.

It should be noted that the size of the oxide inclusions is set to not less than 10 μm, because the non-metallic inclusions having this range of size have a possibility that the fatigue strength is especially influenced. Moreover, it is difficult to exactly confirm the number of excessively small non-metallic inclusions.

Figure 3:
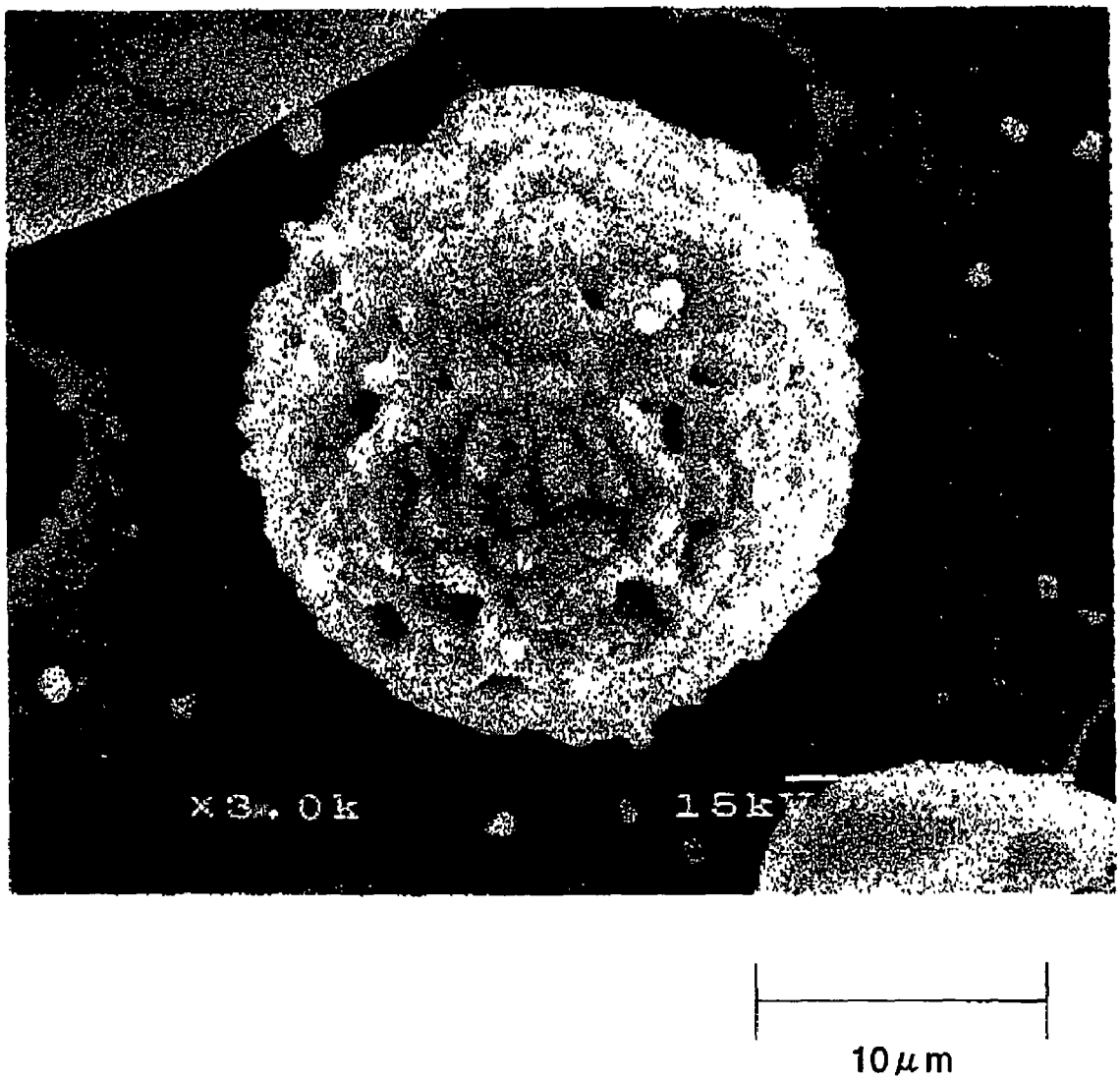
FIG. 3 is an electron microscopic photograph showing one example of an alumina inclusion.
Figure 4:
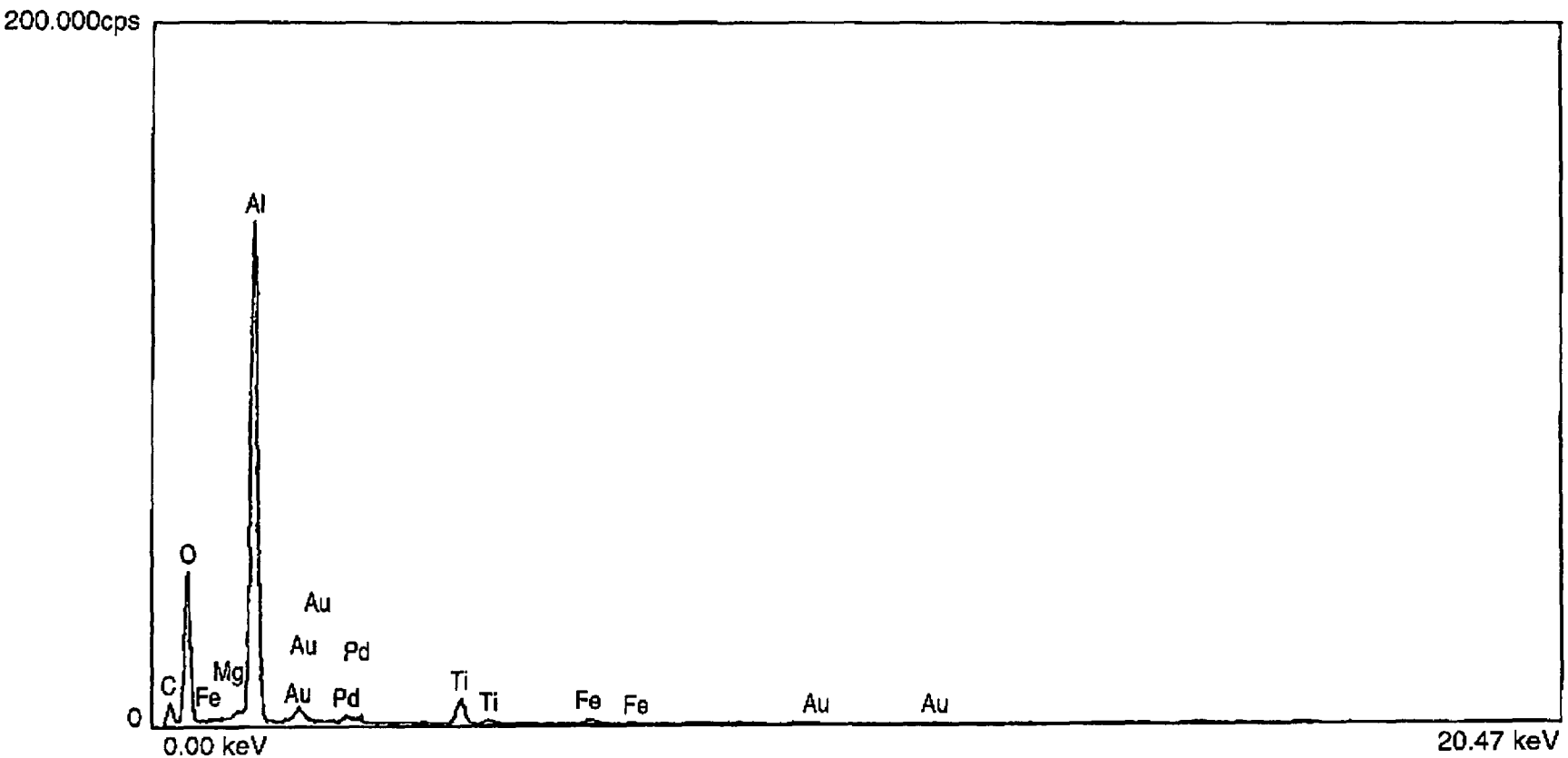
FIG. 4 is a schematic diagram showing the X-ray analysis result of the alumina inclusion.

It should be noted that the alumina inclusions mentioned in the present invention indicate such non-metallic inclusions that an oxygen (O) peak is mainly detected in gas components constituting the non-metallic inclusions, for example, as shown in FIGS. 3, 4 at the time of qualitative/quantitative analysis of the non-metallic inclusions in a structure by an energy dispersed type X-ray analysis device (EDX), and Al occupies not less than 85 mass % in the detected elements other than oxygen (O).

Figure 2:
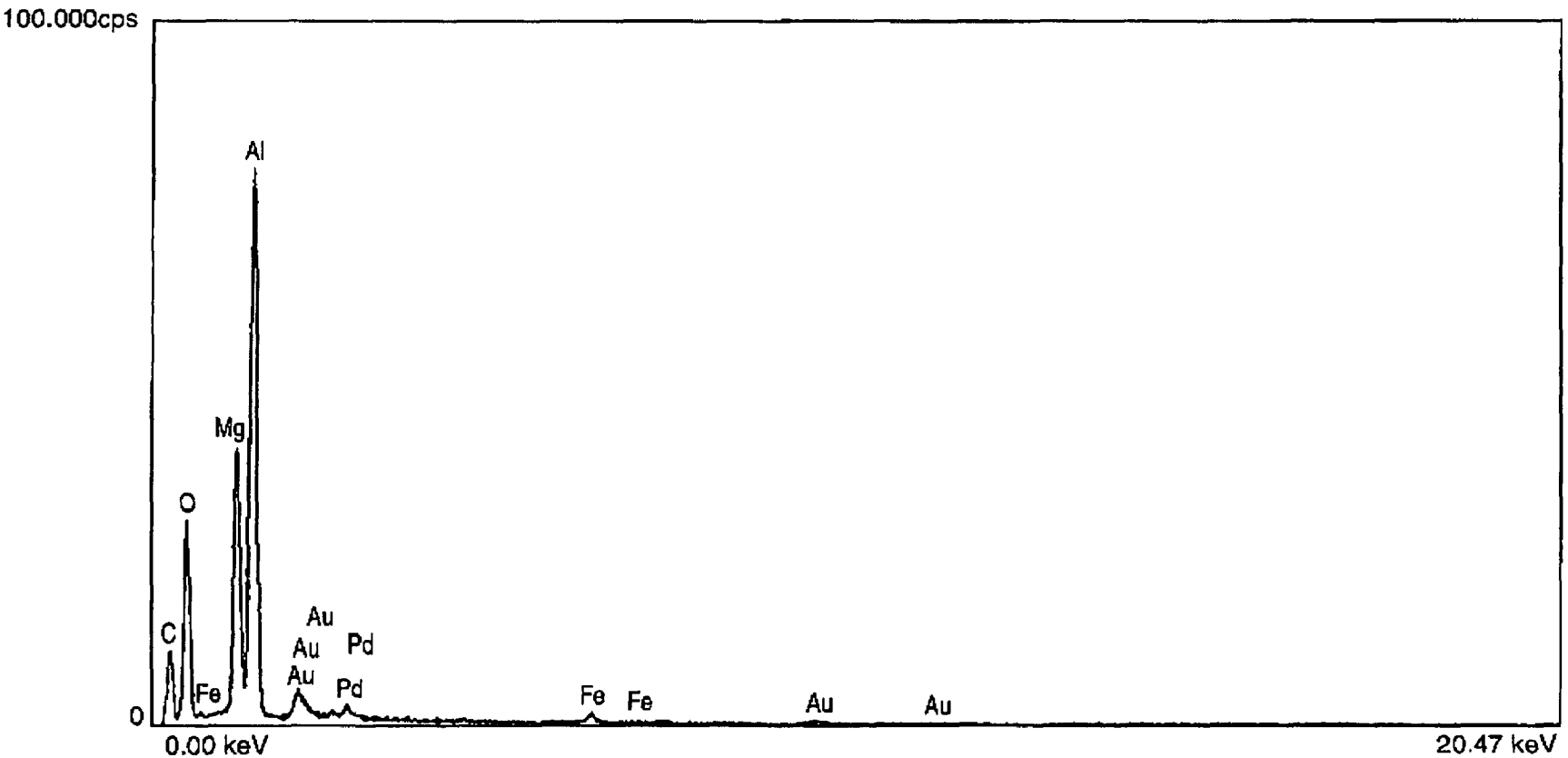
FIG. 2 is a schematic diagram showing an X-ray analysis result of the spinel form inclusion.

Furthermore, the spinel form inclusions indicate such non-metallic inclusions that the oxygen (O) peak is mainly detected in the gas components constituting the non-metallic inclusions, for example, as shown in FIGS. 1, 2, the content of Al is less than 85 mass % in the detected elements other than O, and Mg is detected.

It should be noted that, for example, when a metal block test piece is used in analyzing the non-metallic inclusions, an influence of matrix (base) is large, major components of the maraging steel are detected, and therefore the non-metallic inclusions may be extracted and analyzed. Additionally, as shown in FIGS. 1 and 3, many oxide inclusions have a spherical shape. Therefore, an area analysis in a certain degree of range is better than a point analysis.

Moreover, in addition to the adjustment of the rate of the alumina inclusions to the total number of the above oxide inclusions, in the producing method of the present invention, an Mg addition amount and producing conditions of an electrode ingot are adjusted. Moreover, when VIM, VAR, and the like are combined, a maximum length of the oxide non-metallic inclusions can be set to not more than 20 μm, and the maximum length of the nitride inclusions can be set to not more than 15 μm.

When the maximum length of the oxide inclusions is set to not more than 20 μm, a possibility that the inclusions constitute fracture origin of fatigue fracture can be reduced, and the maraging steel thin strip becomes especially suitable for the component for the continuously variable transmission, which has the high fatigue strength.

When the maximum length of the nitride-base non-metallic inclusions is also set to not more than 15 μm, the possibility that the inclusions constitute the fracture origin of the fatigue fracture can further be reduced, and the maraging steel thin strip becomes especially suitable for the component for the continuously variable transmission, which has the high fatigue strength. The maximum length of the nitride inclusions is preferably not more than 10 μm. It should be noted that when the appropriate amount of Mg is added, and the above electrode ingot producing conditions are adjusted, the maximum length of the nitride inclusions can also be set to 8 μm or less.

Moreover, the maximum length mentioned in the present invention is evaluated by the diameter of a circle circumscribed with the non-metallic inclusion, when the non-metallic inclusions is oxide, and the diameter of the circumscribed circle is defined as the maximum length of the non-metallic inclusions. Additionally, since the nitride inclusions have a rectangular shape, a long side "a" and a short side "b" are measured, and the diameter of a circle corresponding to an area a×b is assumed as the maximum length.

Next, reasons for the limitation of the composition range of the maraging steel of the present invention will be described. The content is represented by mass %, unless otherwise mentioned.

First, the reasons for the limitation of Mg, oxygen (O), nitrogen (N) indispensably defined will be described.

Mg is indispensably added at the time of the production of the electrode, and remains as an indispensable component, even when formed into the maraging steel after the vacuum remelting. However, when 15 ppm or more of Mg remains, the excessive amount of remaining Mg is not preferable for a maraging steel product or a maraging steel material for the plastic working from a viewpoint of toughness. Therefore, the vacuum remelting of the present invention may preferably be applied to reduce Mg to less than 15 ppm.

For this, the upper limit of Mg in the consumable electrode described above is preferably controlled to not more than 250 ppm, and it is necessary to set the upper limit to less than 15 ppm for the maraging steel subjected to the vacuum remelting.

The content of oxygen (O) forms the oxide-base non-metallic inclusions, and is therefore limited to less than 10 ppm. With the content of 10 ppm or more of O, the fatigue strength remarkably decreases, and therefore the content is set to be less than 10 ppm.

The content of nitrogen (N) forms the nitride or carbonitride inclusions, and is therefore limited to less than 15 ppm. With the content of 15 ppm or more of N, the fatigue strength remarkably decreases, and therefore the content is set to be less than 15 ppm.

Next, in addition to the above-described chemical composition, the reasons for the limitation of the components defined in the preferable range will be described.

Since C forms carbide, decreases the precipitation of intermetallic compounds, and lowers the fatigue strength, the upper limit of C is set to not more than 0.01% in the present invention.

Ni is an indispensable element for forming a matrix high in toughness, but the toughness is deteriorated with a content which is less than 8.0%. On the other hand, when the content exceeds 22%, austenite is stabilized, it is difficult to form a martensite structure, and therefore Ni is set to 8.0 to 22.0%.

Ti forms a fine intermetallic compound by the aging treatment, and is an indispensable element that contributes to the strengthening when precipitated. However, when the content exceeds 2.0%, ductility and toughness are deteriorated, and therefore the content of Ti is set to not more than 2.0%.

Co does not largely influence the stability of the martensite structure which is a matrix, lowers solubility of Mo, promotes Mo to form the fine intermetallic compound and to be precipitated, and accordingly contributes to the strengthening of the precipitation. When the content is less than 5.0%, the effect is not necessarily sufficiently obtained. Moreover, when the content exceeds 20.0%, a tendency to embrittlement is seen. Therefore, the content of Co is set to 5.0 to 20.0%.

Mo forms fine intermetallic compounds by the aging treatment, and is precipitated in the matrix to contribute to the strengthening. However, when the content is less than 2.0%, the effect is little. Moreover, when the content exceeds 9.0%, coarse precipitates are easily formed containing major elements Fe, Mo that deteriorate the ductility and toughness, and therefore the content of Mo is set to 2.0 to 9.0%.

Al not only contributes to the strengthening by aging precipitation but also has a deoxidation function. However, when the content exceeds 1.7%, the toughness is deteriorated, and therefore the content is set to not more than 1.7%.

It should be noted that in the present invention, elements other than the defined elements are substantially Fe. However, for example, B is an element effective for refining crystal grains, and may therefore be contained in a range of not more than 0.01% so that the toughness is not deteriorated.

Moreover, unavoidable impurity elements are contained. Among the elements, Si, Mn promote the precipitation of the coarse intermetallic compounds causing the embrittlement, lower the ductility or toughness, and form the non-metallic inclusions to lower the fatigue strength. Therefore, both Si, Mn may be contained by not more than 0.1%, preferably not more than 0.05%. Moreover, P, S also embrittle grain boundaries or form the non-metallic inclusions to lower the fatigue strength, and therefore the content may be set to not more than 0.01%.

EXAMPLES

Examples of the present invention will hereinafter be described in more detail.

The consumable electrode for VAR melting was produced by VIM while the content of Mg was changed in six ways in representative components of maraging steel. Moreover, as a comparative material, the consumable electrode was also produced by VIM on a condition that Mg was not added. The same cast dimension and cast rate were used for the consumable electrode (Nos. 1 to 6).

In VIM, the raw materials were selected and subjected to vacuum refining. In the same manner as the oxide inclusions, the sizes of the carbonitride inclusions of titanium, such as TiCN and TiN, that adversely affect fatigue characteristics of the maraging steel were controlled to be not more than 10 μm.

In a control method, the cast rate at the time of the production of the electrode was set to 2.5, and the coagulation speed was increased by blast cooling of a mold after the casting. It should be noted that as the raw material, a raw material containing a small content of nitrogen which was 15 ppm was used.

In addition to the treatment for carbonitride, Mg was added by an Ni—Mg alloy, and the electrode for use in producing VAR ingot was produced.

For the addition of Mg, there is a method of directly adding Mg alloys such as Ni—Mg and Fe—Mg, or metal Mg to molten steel. However, this time, the addition by the Ni—Mg alloy was performed because the handling was facilitated and the content of Mg was easily adjusted.

Furthermore, to clarify the influence of the Mg addition onto nitride or carbonitride, six consumable electrodes (Nos. 7 to 12) were produced while the nitrogen concentration was adjusted to 5 ppm and 10 ppm, and the vacuum remelting was performed.

The electrodes produced by VIM were remelted using VAR on the same condition to produce the steel ingot. The same mold for VAR was used, a degree of vacuum was set to 1.3 Pa, and a steady state of the steel ingot was melted at a projection current of 6.5 KA.

The chemical compositions of the consumable electrodes produced by VIM and the steel ingots obtained by the vacuum remelting of the electrodes by VAR are shown in Table 1. For Nos. 7 to 12, the influences of the Mg addition onto nitrogen or carbonitride were checked. It should be noted that the consumable electrode is shown as "electrode", and the electrode subjected to VAR is shown as "steel ingot".

TABLE 1

| No | | C | Ni | Co | Mo | Ti | Al | N | O | Mg | Fe | Remarks |
|---|---|---|---|---|---|---|---|---|---|---|---|---|
| 1 | Electrode | 0.004 | 18.2 | 9.5 | 4.9 | 0.45 | 0.11 | 0.0014 | 0.0005 | 0.0005 | Bal. | Invention steel |
| | Steel ingot | 0.004 | 18.2 | 9.5 | 4.9 | 0.45 | 0.11 | 0.0007 | 0.0005 | 0.0001 | Bal. | |
| 2 | Electrode | 0.004 | 18.3 | 9.5 | 5.0 | 0.47 | 0.13 | 0.0010 | 0.0006 | 0.0009 | Bal. | Invention steel |
| | Steel ingot | 0.004 | 18.3 | 9.5 | 5.0 | 0.47 | 0.13 | 0.0008 | 0.0005 | 0.0001 | Bal. | |
| 3 | Electrode | 0.003 | 18.3 | 9.4 | 5.0 | 0.46 | 0.14 | 0.0013 | 0.0004 | 0.0014 | Bal. | Invention steel |
| | Steel ingot | 0.003 | 18.3 | 9.4 | 5.0 | 0.46 | 0.14 | 0.0007 | 0.0005 | 0.0002 | Bal. | |
| 4 | Electrode | 0.004 | 18.2 | 9.4 | 5.0 | 0.45 | 0.13 | 0.0011 | 0.0005 | 0.0020 | Bal. | Invention steel |
| | Steel ingot | 0.004 | 18.2 | 9.4 | 5.0 | 0.45 | 0.13 | 0.0007 | 0.0004 | 0.0002 | Bal. | |
| 5 | Electrode | 0.004 | 18.2 | 9.4 | 5.0 | 0.49 | 0.12 | 0.0012 | 0.0008 | 0.0001 | Bal. | Comparative steel |
| | Steel ingot | 0.004 | 18.2 | 9.4 | 5.0 | 0.49 | 0.12 | 0.0008 | 0.0005 | 0.0001 | Bal. | |
| 6 | Electrode | 0.004 | 18.3 | 9.5 | 4.9 | 0.45 | 0.13 | 0.0013 | 0.0007 | 0.0003 | Bal. | Comparative steel |
| | Steel ingot | 0.004 | 18.3 | 9.5 | 4.9 | 0.45 | 0.13 | 0.0007 | 0.0005 | 0.0001 | Bal. | |
| 7 | Electrode | 0.005 | 18.4 | 9.2 | 5.5 | 0.44 | 0.13 | 0.0005 | 0.0005 | 0.0029 | Bal. | Invention steel |
| | Steel ingot | 0.004 | 18.3 | 9.2 | 5.5 | 0.44 | 0.12 | 0.0005 | 0.0005 | 0.0005 | Bal. | |
| 8 | Electrode | 0.003 | 17.9 | 9.3 | 5.3 | 0.47 | 0.10 | 0.0005 | 0.0006 | 0.0008 | Bal. | Invention steel |
| | Steel ingot | 0.002 | 17.9 | 9.2 | 5.3 | 0.47 | 0.10 | 0.0005 | 0.0005 | 0.0001 | Bal. | |
| 9 | Electrode | 0.005 | 18.1 | 8.9 | 5.1 | 0.49 | 0.12 | 0.0010 | 0.0004 | 0.0048 | Bal. | Invention steel |
| | Steel ingot | 0.004 | 18.1 | 8.9 | 5.0 | 0.48 | 0.12 | 0.0009 | 0.0004 | 0.0011 | Bal. | |
| 10 | Electrode | 0.003 | 18.3 | 9.4 | 4.9 | 0.46 | 0.12 | 0.0010 | 0.0005 | 0.0017 | Bal. | Invention steel |
| | Steel ingot | 0.003 | 18.3 | 9.5 | 5.0 | 0.46 | 0.11 | 0.0009 | 0.0004 | 0.0003 | Bal. | |
| 11 | Electrode | 0.005 | 18.3 | 9.2 | 5.1 | 0.46 | 0.13 | 0.0005 | 0.0006 | 0.0002 | Bal. | Comparative steel |
| | Steel ingot | 0.004 | 18.3 | 9.2 | 5.0 | 0.45 | 0.13 | 0.0005 | 0.0004 | 0.0001 | Bal. | |
| 12 | Electrode | 0.004 | 18.0 | 9.3 | 5.3 | 0.44 | 0.12 | 0.0010 | 0.0004 | 0.0003 | Bal. | Comparative steel |
| | Steel ingot | 0.003 | 18.1 | 9.2 | 5.3 | 0.44 | 0.13 | 0.0009 | 0.0003 | 0.0001 | Bal. | |

(mass %)

The obtained steel ingots subjected to VAR were soaked at 1250° C.×20 hours, and subsequently subjected to the hot forging to form hot forged materials.

Next, these materials were subjected to the hot rolling, solution treatment at 820° C.×one hour, cold rolling, solution treatment at 820° C.×1 hour, and aging treatment at 480° C.×5 hours to produce a maraging steel thin strip having a thickness of 0.5 mm.

First, a specimen having a weight of 100 g was taken from each steel ingot of Nos. 1 to 6 to dissolve in a mixed acid solution or a bromo methanol solution. The thus obtained each ferrous solution was filtered with a filter to obtain a residue of oxides on the filter. The respective residue was observed by means of SEM to examine a chemical composition and a size of oxide inclusions. Results are shown in Table 2.

Further, specimens having a weight of 100 g were taken from transversely the both end regions of the respective strip of maraging steel of Nos. 1 to 6 to dissolve in a mixed acid solution or a bromo methanol solution. The thus obtained each ferrous solution was filtered with a filter to obtain a residue of oxides on the filter. The respective residue was observed by means of SEM to examine a chemical composition and a size of oxide inclusions.

When measuring the non-metallic inclusions, a diameter of a circle circumscribed with the respective non-metallic inclusions was determined as the maximum length of the non-metallic inclusion. Results are shown in Table 3.

TABLE 2

| No. | Rate of 10 μm or more spinel form inclusions | Rate of 10 μm or more alumina inclusions | Maximum length of oxide inclusions (μM) | Remarks |
|---|---|---|---|---|
| 1 | 70.0% | 30.0% | 19.8 | Invention steel |

TABLE 2-continued

| No. | Rate of 10 μm or more spinel form inclusions | Rate of 10 μm or more alumina inclusions | Maximum length of oxide inclusions (μM) | Remarks |
|---|---|---|---|---|
| 2 | 92.0% | 8.0% | 17.6 | Invention steel |
| 3 | 100% | 0% | 16.3 | Invention steel |
| 4 | 100% | 0% | 15.2 | Invention steel |
| 5 | 25.0% | 75.0% | 25.4 | Comparative steel |
| 6 | 31.5% | 69.5% | 23.7 | Comparative steel |

TABLE 3

| No. | Rate of 10 μm or more spinel form inclusions | Rate of 10 μm or more alumina inclusions | Maximum length of oxide inclusions (μm) | Remarks |
|---|---|---|---|---|
| 1 | 33.3% | 66.7% | 16.0 | Invention steel |
| 2 | 83.3% | 16.7% | 14.1 | Invention steel |
| 3 | 100% | 0% | 12.8 | Invention steel |
| 4 | 100% | 0% | 12.5 | Invention steel |
| 5 | 17.1% | 82.9% | 22.4 | Comparative steel |
| 6 | 17.1% | 82.9% | 22.4 | Comparative steel |

It can be seen from Tables 2 and 3 that, when the content of Mg of the consumable electrode exceeds 5 ppm, the oxide inclusions exceeding a size of 20 μm are eliminated in the maraging steel, and that the more the Mg content in the electrode is, the smaller the size of the oxide inclusions becomes.

It can be seen also that the sizes of the oxide inclusions in Sample Nos. 1 to 6 were reduced by subjecting the steel ingots to plastic working to obtain the steel strips. Such size reduction will be by virtue of crush of the oxide inclusions by plastic working.

Further, the composition of the oxide inclusions observed in this evaluation mainly includes the spinel form inclusions and MgO in accordance with the present invention. Most of the oxide inclusions other than the alumina inclusions having a size of not less than 10 μm in Table 2 is the spinel form inclusions and MgO. In comparative examples, the alumina inclusions are mainly contained.

It should be noted that the chemical composition of the thin strip having a thickness of 0.5 mm is the same as that of "the steel ingot" in Table 1. It was also confirmed by scanning type electron microscope observation that the maximum length of any inclusion of TiN or TiCN was not more than 15 μm.

FIG. 1 shows an electron microscope photograph of the spinel form inclusion seen in the maraging steel ingot No. 1, and the chemical composition peak is shown in FIG. 2. FIG. 3 shows an electron microscope photograph of the alumina inclusion seen in the maraging steel ingot No. 5, and the chemical composition peak is shown in FIG. 4. It is well seen that the type and size of the non-metallic inclusion differ between both the compositions.

It should be noted that Au and Pd, which can be seen in the diagrams of FIGS. 2 and 4, are not included in the non-metallic inclusions but are deposited on the specimens by sputtering when conducting an SEM observation and an EDX analysis.

Next, a specimen having a weight of 100 g was taken from each steel ingot of Nos. 7 to 12 to dissolve in a mixed acid solution or a bromo methanol solution. The thus obtained each ferrous solution was filtered with a filter to obtain a residue of oxides on the filter. The respective residue was observed by means of SEM to examine a chemical composition and a size of oxide inclusions. Results are shown in Table 4.

Further, specimens having a weight of 100 g were taken from transversely the both end regions of the respective strip of maraging steel of Nos. 7 to 12 to dissolve in a mixed acid solution or a bromo methanol solution. The thus obtained each ferrous solution was filtered with a filter to obtain a residue of oxides on the filter. The respective residue was observed by means of SEM to examine a chemical composition and a size of oxide inclusions.

Furthermore, in order to examine nitrides or carbonitrides, a specimen having a weight of 10 g was taken from each of the Samples ingots and steel strips of Nos. 7 to 12 to dissolve in a mixed acid solution or a bromo methanol solution. The thus obtained each ferrous solution was filtered with a filter which has a smaller mesh size than that of the above filter used for oxide inclusions in order to increase a capture rate of nitrides or carbonitrides as residue. With regard to the thus captured respective residue, 10,000 pieces of nitrides or carbonitrides were observed by means of SEM, and the maximum size was determined.

Since nitride had a rectangular shape, the long side a and the short side b were measured, and the diameter of the circle corresponding to the area a×b was measured as the maximum length. It is to be noted that for the oxide inclusions, the diameter of the circle circumscribed with the non-metallic inclusion was measured as the maximum length of the non-metallic inclusion. The measurement results are shown in Table 5.

| No. | Electrode nitrogen (ppm) | Rate of 10 μm or more spinel form inclusions | Rate of 10 μm or more alumina inclusions | Maximum length of oxide inclusions (μm) | Maximum length of nitride inclusions (um) | Remarks |
|---|---|---|---|---|---|---|
| 7 | 5 | 100% | 0% | 13.8 | 3.3 | Invention steel |
| 8 | 5 | 92.0% | 8.0% | 17.2 | 4.3 | Invention steel |
| 9 | 10 | 100% | 0% | 13.1 | 6.7 | Invention steel |
| 10 | 10 | 100% | 0% | 12.5 | 7.2 | Invention steel |
| 11 | 5 | 22.0% | 78.0% | 22.4 | 6.1 | Comparative steel |
| 12 | 10 | 30.5% | 69.5% | 24.7 | 10.8 | Comparative steel |

TABLE 5

| No. | Electrode nitrogen (ppm) | Rate of 10 μm or more spinel form inclusions | Rate of 10 μm or more alumina inclusions | Maximum length of oxide inclusions (μm) | Maximum length of nitride inclusions (um) | Remarks |
|---|---|---|---|---|---|---|
| 7 | 5 | 100% | 0% | 11.0 | 3.4 | Invention steel |
| 8 | 5 | 85% | 15% | 14.1 | 4.3 | Invention steel |
| 9 | 10 | 100% | 0% | 9.8 | 6.8 | Invention steel |
| 10 | 10 | 100% | 0% | 10.6 | 7.1 | Invention steel |
| 11 | 5 | 15% | 85% | 21.6 | 6.2 | Comparative steel |
| 12 | 10 | 21% | 79% | 23.2 | 10.7 | Comparative steel |

It is seen from Table 5 that concerning oxide, when the Mg content of the consumable electrode exceeds 5 ppm in the same manner as in the check results of Nos. 1 to 6 shown in Table 3, the oxide inclusions exceeding a size of 20 μm are eliminated in the maraging steel strip. Most of the oxide inclusions other than the alumina inclusions having a size of not less than 10 μm in Table 3 is the spinel form inclusions and MgO. In the comparative examples, the alumina inclusions are mainly contained.

It can be seen also that the sizes of the oxide inclusions in Sample Nos. 7 to 12 were reduced by subjecting the steel ingots to plastic working to obtain the steel strips. Such size reduction will be by virtue of crush of the oxide inclusions by plastic working.

It is seen that the maximum length of nitride is 2 to 3 μm and nitride becomes fine by the Mg addition with an electrode nitrogen concentration of 5 ppm, and that the maximum length of nitride is 3 to 4 μm and nitride becomes fine by the Mg addition with an electrode nitrogen concentration of 10 ppm.

Figure 5:
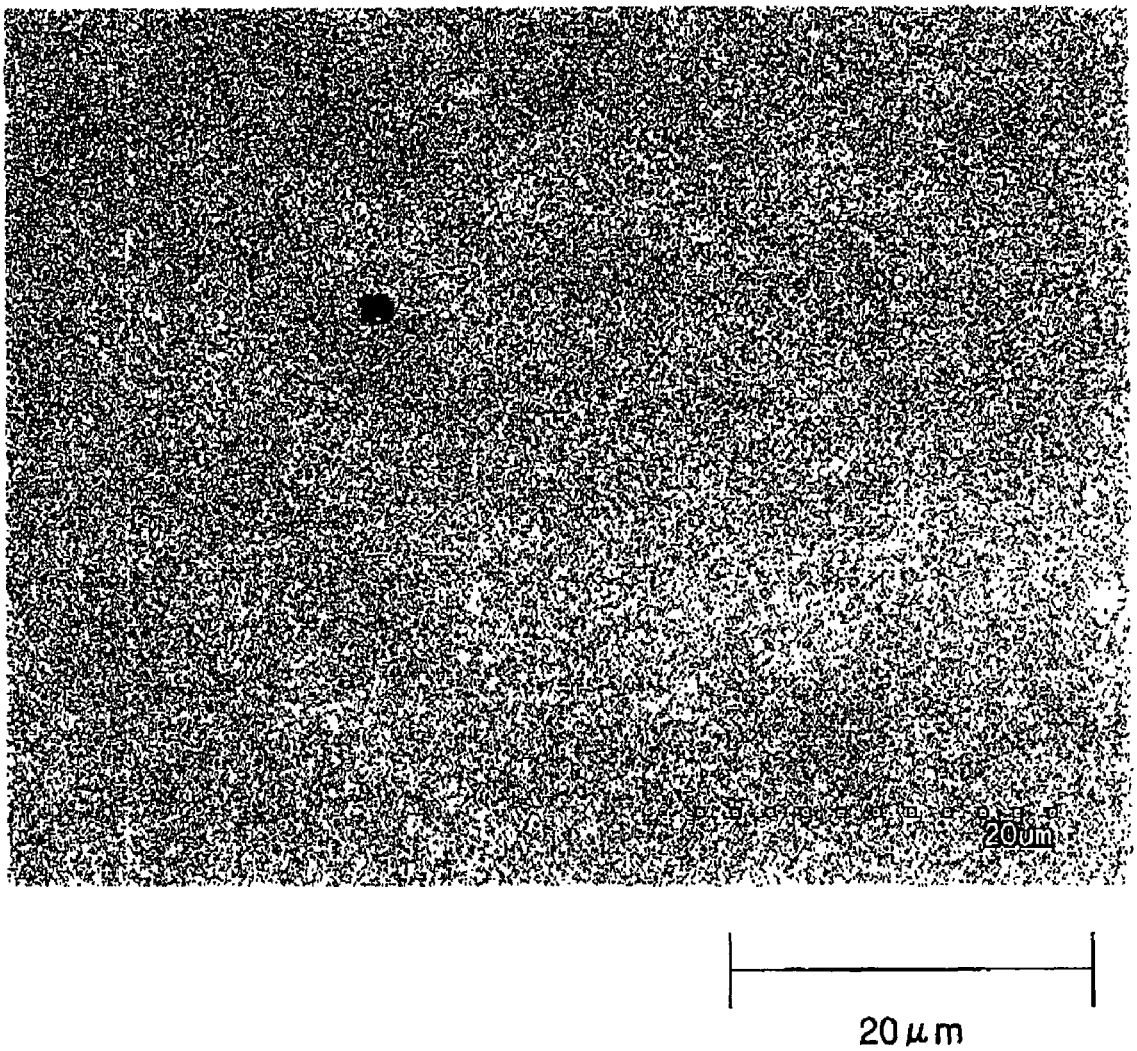
FIG. 5 is an electron microscopic photograph showing one example of an non-metallic inclusion seen in maraging steel of the invention.

The section of the present invention steel No. 8 was observed with SEM, and the non-metallic inclusions observed in the section are shown in FIG. 5. It is seen that the non-metallic inclusions are nitride inclusions, and are very fine.

It is to be noted that the sections of the maraging steel strips Nos. 7 to 12 were linearly analyzed for the maximum and minimum values of Ti and Mo in EPMA, and the rate (maximum value/minimum value) was calculated. It was confirmed that the segregation rate was not more than 1.3 with respect to all the samples.

Next, the samples for a fatigue test were taken from the above-described "steel ingot".

For the samples, the present invention test piece No. 7 and the comparative example test piece No. 11 were soaked at 1250° C.×20 hours, and subsequently subjected to the hot forging to form rod materials having a diameter of 15 mm. Next, the rod materials were subjected to the solution treatment at 820° C.×0.5 hour, and subsequently subjected to the aging treatment at 480° C.×3 hours to prepare ten ultrasonic fatigue test pieces from each of the present invention specimen No. 7 and the comparative example specimen No. 11.

The fatigue test was conducted with respect to the ultrasonic fatigue test pieces in an ultrasonic fatigue tester at a stress amplitude of 400 MPa. The fatigue test was conducted in such a pattern that a run period at a vibration speed of 20 kHz was 80 ms and the tester was stopped for 190 ms for the cooling, and the test was repeated until the test pieces were fractured.

As a result of the observation of fracture origin of the fractured test pieces, it was confirmed that fatigue cracks of the test pieces initiated from the inclusions and the test pieces were fractured. The present invention steel No. 7 had an average fracture life of $10^8$ or more times and had such a long life. However, the average fracture life of the comparative example steel No. 11 was $10^7$ times.

From the above-described results, it has been seen that in the maraging steel of the present invention, the oxide-base non-metallic inclusions can be reduced in size and amount and that it is also possible to reduce the sizes of the nitride-base non-metallic inclusions such as TiN and TiCN and that the maraging steel has a superior fatigue strength.

The thin strip of the maraging steel of the present invention is optimum as the component for the continuously variable transmission of the automobile engine.

When the method of producing the maraging steel of the present invention is applied, the oxide-base non-metallic inclusions can be reduced in size and amount, it is also possible to reduce the sizes of the nitride-base non-metallic inclusions such as TiN and TiCN, and the present invention is optimum for the application requiring a strict fatigue strength. The present invention is optimum for the representative application such as the component for the continuously variable transmission of the automobile engine.

What is claimed is:

1. A method of producing maraging steel and controlling the growth of oxide and titanium nitride inclusions in the maraging steel by the addition of a controlled amount of Mg added to a consumable electrode which is subjected to vacuum arc remelting, the maraging steel exhibiting improved fatigue strength containing from not less than 0.3 mass % to not more than 2.0 mass % of Ti, and from more than zero to less than 15ppm of Mg, less than 10 ppm oxygen and less than 15 ppm nitrogen which method comprises:

producing a consumable electrode wherein the consumable electrode contains oxide inclusions and titanium nitride inclusions and the consumable electrode is subjected to vacuum arc remelting by casting a molten steel which has been melted under vacuum, the consumable electrode containing Mg, and non-metallic inclusions comprising oxide inclusions and titanium nitride inclusions, which titanium nitride inclusions have a nucleus of MgO, wherein the total of all Mg present is not less than 5 ppm; and subsequently subjecting the consumable electrode to vacuum arc remelting to control the growth of the oxide inclusions and the titanium nitride inclusions, whereby the titanium nitride inclusions and the nucleus of MgO in the titanium nitride inclusions are decomposed so that the Mg content in the maraging steel which is produced by the vacuum arc remelting is reduced from the Mg content in the consumable electrode due to vaporization so that the Mg content in the maraging steel is made to be less than the Mg content in the consumable electrode, wherein the maraging steel contains the titanium nitride inclusions having a size of not more than 15 μm in maximum length and the oxide inclusions having a size of not more than 20 μm in maximum length, and wherein the oxide inclusions comprise spinel form inclusions and alumina inclusions in which a content of the spinel form inclusions having a size of not less than 10 μm in length divided by a total content of the spinel form inclusions having a size of not less than 10 μm in length plus the alumina inclusions having a size of not less than 10 μm in length is more than 0.33.

2. A method of producing maraging steel according to claim 1, wherein the molten steel for casting has been produced by a vacuum induction melting process.

3. A method of producing maraging steel according to claim 1, wherein a maraging steel product obtained by the vacuum arc remelting is subjected to plastic working to produce a thin strip having a thickness of not more than 0.5 mm.

4. Maraging steel comprising, by mass, at least, from not less than 0.3% to not more than 2.0% Ti, from more than zero to less than 15 ppm of Mg, less than 10 ppm oxygen and less than 15 ppm nitrogen, wherein the maraging steel contains titanium nitride inclusions having a size of not more than 15 μm in maximum length and oxide inclusions having a size of not more than 20 μm in maximum length, and wherein the oxide inclusions comprise spinel form inclusions and alumina inclusions in which a content of the spinel form inclusions having a size of not less than 10 μm in length divided by a total content of the spinel form inclusions having a size of not less than 10 μm in length plus the alumina inclusions having a size of not less than 10 μm in length is more than 0.33.

5. Maraging steel according to claim 4, consisting essentially of, by mass, not more than 0.01% C (carbon), 8.0 to 22.0% Ni, 5.0 to 20.0% Co, 2.0 to 9.0% Mo, from not less than 0.3% to not more than 2.0% Ti, not more than 1.7% Al, from more than zero to less than 10 ppm Mg, less than 10ppm oxygen, less than 15 ppm nitrogen, and the balance of Fe and incidental impurities.

6. A thin strip which is made from maraging steel as defined in claim 4, and which has a thickness of not more than 0.5 mm.

7. A thin strip which is made from maraging steel as defined in claim 5, and which has a thickness of not more than 0.5 mm.

8. The method according to claim 1, wherein a thin strip having a thickness of not more than 0.5 mm is produced by plastic working the maraging steel after the vacuum arc remelting.

9. The method according to claim 3, wherein the thin strip having a thickness of not more than 0.5 mm is a component of a continuously variable transmission.

10. The method according to claim 8, wherein the thin strip having a thickness of not more than 0.5 mm is a component of a continuously variable transmission.

11. A component of a continuously variable transmission, which is made of the thin strip having a thickness of not more than 0.5 mm as defined in claim 6.

12. A component of continuously variable transmissions, which is made of the thin strip having a thickness of not more than 0.5 mm as defined in claim 7.

13. A method of producing maraging steel according to claim 1, wherein the amount of Mg is from more than 0 to less than 10 ppm in the maraging steel and wherein the consumable electrode contains from 10 to 150 ppm Mg.

14. A method of producing maraging steel according to claim 1, wherein the consumable electrode contains from 5 to not more than 300 ppm Mg.

15. A method of producing maraging steel according to claim 1, wherein the consumable electrode contains from 5 to not more than 250 ppm Mg.

16. A method of producing maraging steel according to claim 1, wherein the maraging steel consists essentially of, by mass, not more than 0.01% C (carbon), 8.0 to 22.0% Ni, 5.0 to 20.0% Co, 2.0 to 9.0% Mo, from not less than 0.3% to not more than 2.0% Ti, not more than 1.7% Al, from more than zero to less than 10 ppm Mg, less than 10 ppm oxygen, less than 15 ppm nitrogen, and the balance of Fe and incidental impurities.

17. A method of producing maraging steel according to claim 13, wherein the maraging steel compounds by mass from more than 0 to 5 ppm Mg.

18. Maraging steel according to claim 4, wherein the maraging steel comprises by mass, from more than 0 to 5 ppm Mg.

19. A method according to claim 13, wherein a maraging steel product obtained by the vacuum arc remelting is subjected to plastic working to produce a thin strip having a thickness of not more than 0.5 mm.

20. A method according to claim 19, wherein the thin strip having a thickness of not more than 0.5 mm is a component of a continuously variable transmission.

* * * * *